US009816216B2

(12) United States Patent
Eydner

(10) Patent No.: US 9,816,216 B2
(45) Date of Patent: Nov. 14, 2017

(54) NOZZLE FOIL FOR A NOZZLE BAR WITH CONNECTABLE FOIL SEGMENTS

(75) Inventor: Reinhold Eydner, Albstadt (DE)

(73) Assignee: GROZ-BECKERT KG, Albstadt (DE)

( * ) Notice: Subject to any disclaimer, the term of this patent is extended or adjusted under 35 U.S.C. 154(b) by 1209 days.

(21) Appl. No.: 12/881,967

(22) Filed: Sep. 14, 2010

(65) Prior Publication Data

US 2011/0067213 A1 Mar. 24, 2011

(30) Foreign Application Priority Data

Sep. 18, 2009 (EP) ..... 09011918

(51) Int. Cl.
*D04H 18/04* (2012.01)

(52) U.S. Cl.
CPC ..... *D04H 18/04* (2013.01)

(58) Field of Classification Search
CPC ..... B05B 1/14; B05B 1/20; D04H 18/04
USPC ..... 239/552, 566, 600
See application file for complete search history.

(56) References Cited

U.S. PATENT DOCUMENTS

| | | | | |
|---|---|---|---|---|
| 1,020,024 | A * | 3/1912 | Casebolt | 239/420 |
| 2,357,392 | A | 9/1944 | Francis | |
| 2,609,539 | A | 9/1952 | Shearer | |
| 2,702,261 | A | 2/1955 | Bacon | |
| 3,825,379 | A | 7/1974 | Lohkamp et al. | |
| 4,228,123 | A | 10/1980 | Marshall | |
| 4,522,716 | A | 6/1985 | LaValley | |
| 4,697,292 | A | 10/1987 | LaValley | |
| 4,714,647 | A | 12/1987 | Shipp, Jr. et al. | |
| 4,795,558 | A | 1/1989 | LaValley | |
| 4,880,168 | A | 11/1989 | Randall, Jr. et al. | |
| 5,028,007 | A | 7/1991 | Wokal | |

(Continued)

FOREIGN PATENT DOCUMENTS

| | | | |
|---|---|---|---|
| CN | 1411519 | A | 4/2003 |
| CN | 101107392 | A | 1/2008 |

(Continued)

OTHER PUBLICATIONS

State Intellectual Property Office, P. R. China First Office Action and English Translation; dated Oct. 9, 2012; 13 pgs.

(Continued)

*Primary Examiner* — Christopher Kim
(74) *Attorney, Agent, or Firm* — Fitch, Even, Tabin & Flannery LLP

(57) ABSTRACT

A nozzle foil (12), for a nozzle bar (10) of a textile processing machine, having a plurality of nozzle openings (16) arranged in one or more rows (40) in a longitudinal direction L. The nozzle foil (12) consists of at least two adjacent foil segments (25) that can be mechanically connected with each other in a form-fitting manner. With the connection established, the upper sides (15) and the undersides (17) of the foil segments (25) are in a common plane. To accomplish a form-fitting connection, connecting means (27) provided on one foil segment (25) interact with opposing connecting means (28) of the other foil segment (25). The connecting means (27) and the opposing connecting means (28) are integral components of the respective foil segment (25) and preferably are manufactured at the same time as the respective foil segment (25) and consist of the same material as the respective foil segment (25).

15 Claims, 4 Drawing Sheets

(56) References Cited

U.S. PATENT DOCUMENTS

| | | | |
|---|---|---|---|
| 5,235,733 | A | 8/1993 | Willbanks et al. |
| 5,692,278 | A | 12/1997 | Fleissner |
| 5,933,931 | A | 8/1999 | Greenway |
| 6,230,776 | B1 | 5/2001 | Choi |
| 6,668,436 | B2 | 12/2003 | Noelle et al. |
| 7,237,308 | B2 | 7/2007 | Dixon et al. |
| 7,303,465 | B2 | 12/2007 | Pourdeyhimi et al. |
| 8,257,626 | B2 | 9/2012 | Kuehl |
| 2002/0179744 | A1 | 12/2002 | Noelle et al. |
| 2003/0116878 | A1 | 6/2003 | Takagaki |
| 2004/0026543 | A1 | 2/2004 | Fleissner |
| 2004/0078945 | A1 | 4/2004 | Fleissner |
| 2005/0219505 | A1 | 10/2005 | Fleissner |
| 2006/0124772 | A1 | 6/2006 | Pourdeyhimi et al. |
| 2008/0113054 | A1 | 5/2008 | Fegelman et al. |
| 2011/0067214 | A1 | 3/2011 | Raedle |
| 2011/0067458 | A1 | 3/2011 | Eydner |

FOREIGN PATENT DOCUMENTS

| | | |
|---|---|---|
| DE | 220060 | 3/1985 |
| DE | 3727843 | 1/1989 |
| DE | 19956368 | 6/2001 |
| DE | 10022297 | 11/2001 |
| DE | 10203719 | 7/2003 |
| DE | 102004030393 | 1/2006 |
| DE | 102005008647 | 8/2006 |
| EP | 1323857 | 7/2007 |
| WO | 9929950 | 12/1999 |
| WO | 0029656 | 5/2000 |
| WO | 0144553 | 6/2001 |
| WO | 0153587 | 7/2001 |
| WO | 0224998 | 3/2002 |
| WO | 0248441 | 6/2002 |
| WO | 03066948 | 8/2003 |
| WO | 2006063112 | 6/2006 |

OTHER PUBLICATIONS

European Patent Office, European Search Report, related application EP09012009, dated Jan. 15, 2010.

State Intellectual Property Office, P.R. China First Office Action and English Translation; Oct. 9, 2012; 13 pgs.

* cited by examiner

NOZZLE FOIL FOR A NOZZLE BAR WITH CONNECTABLE FOIL SEGMENTS

CROSS-REFERENCE TO RELATED APPLICATION

The present application claims the priority of European Patent Application No. 09 111 918.1, filed Sep. 18, 2009, the subject matter of which, in its entirety, is incorporated herein by reference.

BACKGROUND OF THE INVENTION

The invention relates to a nozzle foil for a nozzle bar of a textile processing machine.

In order to compact fleece materials the use of textile processing machines has been known, wherein water is ejected at high pressure in very fine, thin jets onto random fiber nonwovens. In so doing, the water jets take over the function of felting needles and of intertwining the fibers of the random fiber nonwoven in order to produce a compact fleece material.

To accomplish this, the textile machine comprises a nozzle bar containing a plurality of nozzle openings by way of which the water is formed into fine, needle-like water jets.

For example, a nozzle strip has been known from U.S. Pat. No. 7,237,308 B2. The nozzle strip comprises a carrier part on which the nozzle foil having the nozzle openings is arranged. In order to simplify handling of the nozzle foil, said foil may be divided into several length sections. The individual length sections are firmly connected to the carrier, for example, with the use of an adhesive such as, for example a UV-curable adhesive or epoxy.

Considering this, the object of the present invention may be viewed as an improvement of the known nozzle foil and, in particular, as a simplification of the installation of said nozzle foil in the nozzle bar of a textile processing machine.

SUMMARY OF THE INVENTION

The above object generally is achieved with a nozzle foil in accordance with the present invention that comprises at least two foil segments that can be connected to each other. For example, the two foil segments can be mechanically connected to each other by connecting means on one of the foil segments and by opposing connecting means on the other foil segment. By dividing the nozzle foil into several foil segments, handling is simplified, i.e., during assembly, as well as during transport of the nozzle foil. Also, the manufacture of shorter foil segments is simpler compared with the manufacture of a nozzle foil that has a length of several meters and enables the use of particularly wear-resistant materials such as, for example, ceramic or hard metal. In addition, the manufacture of shorter foil segments offers more freedom in view of the foil thickness. Thus, it is possible to manufacture foils having a thickness greater than 1 mm, as well as foils having a thickness of a few millimeters. As a result of the fact that the foil segments can be mechanically connected to each other, their relative position in the position of use in the nozzle bar of the textile processing machine is exactly defined. This simplifies the installation of the nozzle foil in the textile processing machine and prevents assembly errors and, hence, also prevents production errors during the manufacture of fleece material.

In so doing, the foil segments of the nozzle foil may be connected to each other in a form-fitting manner. It is also possible, for example, to create a substance-to-substance bond by using an adhesive for the form-fitting connection.

Referring to a preferred embodiment, the connecting means and the opposing connecting means have at least one connecting projection and at least one connecting recess, whereby with the connection established between two foil segments, each connecting projection comes into engagement with a corresponding connecting recess. In so doing, the connecting means may have one or more connecting projections as well as one or more connecting recesses. Correspondingly, the connecting means have connecting recesses or connecting projections that can interact with the associate connecting projections or projection recesses of the connecting means and establish a connection. The connecting projections and connecting recesses are formed on or in the respective foil segment. Preferably, the connecting projections or connecting recesses are manufactured together with the foil segment of one material. During manufacture of the foil segment, for example, they may simply be punched out or cut out with the use of a laser.

At the connecting point between two foil segments, each foil segment preferably has a joining surface that comes into abutment with the respectively associate joining surface of the other foil segment, so that the two foil segments abut against each other by means of their respective joining surfaces. In so doing, the connecting projection may project away from the joining surface of the foil segment. The connecting recesses may be provided in the respective foil segment so as to be recessed with respect to the joining surface.

Advantageously, the connecting projection has a widened end section. As a result of this, an inadvertent separation of the established connection can be avoided in a direction transverse to the widened section. In so doing, the connecting projection of a preferred embodiment may, at the same time, also widen in two directions. This can be achieved in that the widened end section of the connecting projection tapers in an insertion direction in which said end section can be inserted in the associate connecting recess in order to form the connection. In this manner, it is possible to avoid an inadvertent separation of the connection in two directions at the same time. Also, the correct alignment of the upper side and the underside of the two foil segments that are to be connected can thus be ensured.

The joining surface of a foil segment may extend in one plane. However, it is also possible that the joining surface have several adjoining surface sections whose surface normals point in different directions. It is also possible to provide a convexly and/or concavely curved joining surface. In so doing, it is possible for two foil segments to overlap each other in the region of the connecting point, once the connection has been established. For example, the joining surface may extend in a stepped manner. To do so, one or more surface sections of the joining surface may be present on a projecting joining part of a foil segment, whereby the joining parts —with the connection established—are arranged above each other or next to each other, and an overlap results in the region of the connecting point of the foil segments.

Advantageous embodiments of the invention are obvious from the dependent patent claims, the description and the drawings. Hereinafter, the invention will be explained in detail with reference to exemplary embodiments. The description is restricted to essential features of the invention and to miscellaneous situations. The drawings are to be considered as being supplementary.

DETAILED DESCRIPTION OF THE INVENTION

Figure 1:
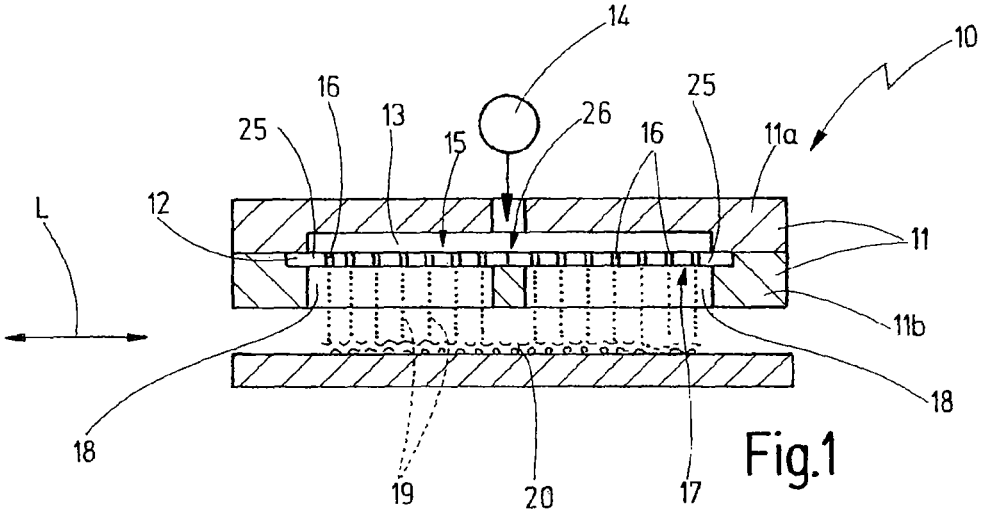
FIG. 1 is a schematic cross-sectional representation of a nozzle bar of a textile processing machine.

FIG. 1 shows a schematic cross-sectional view of a nozzle bar 10 of a textile processing machine for the manufacture of fleece. The nozzle bar 10 comprises a two-part carrier element 11 in which a nozzle foil 12 is placed between an upper part 11*a* and a lower part 11*b*. The upper part 11*a* has an inlet channel 13 to which water is supplied, said water having been pressurized by means of a pressure source 14. The pressurized water moves through the inlet channel 13 to the upper side 15 of the nozzle foil 12. The nozzle foil 12 is provided with a plurality of nozzle openings 16. The water present on the upper side 15 of the nozzle openings 16 is formed so as to produce fine needle-like water jets and is ejected on the underside 17 of the nozzle foil 12 via an outlet channel 18 in the lower part 11 b of the carrier element 11. FIG. 1 shows the water jets 19 schematically dotted. Below the nozzle bar 10, said water jets impinge on a random fiber nonwoven 20, thus intertwining the fibers of the random fiber nonwoven and forming a fleece fabric.

Figure 2:
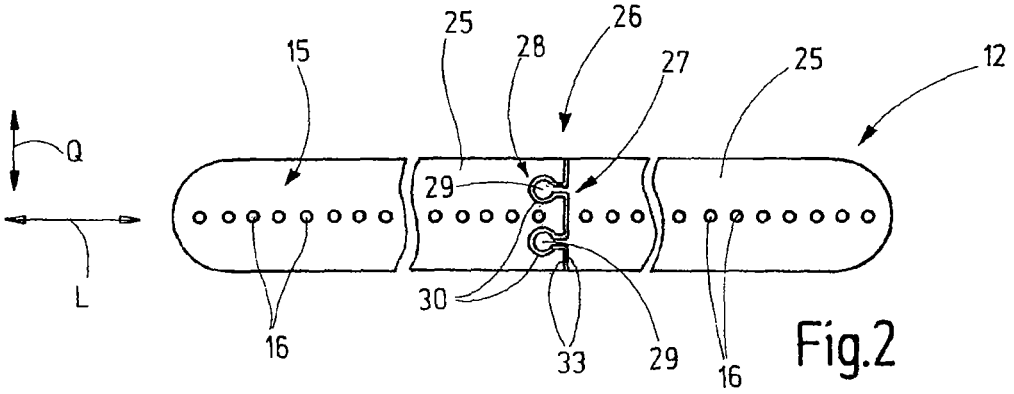
FIGS. 2 to 6 are schematic plan views of various exemplary embodiments of a nozzle foil with several foil segments.

The nozzle foil 12 features a row of nozzle openings 16 that are provided in the nozzle foil 12 at a distance from each other next to each other in longitudinal direction L. The diameter of the nozzle opening 16 may be approximately 0.05 to 0.2 mm. The nozzle foil 12 may have a length of several meters in longitudinal direction L. It is also possible to provide the nozzle openings 16 in several adjacent rows in longitudinal direction L in the nozzle foil 12. The nozzle foil 12 may have a thickness of approximately 0.1 to 1.5 mm. The width of the nozzle foil 12 in a transverse direction Q may be approximately 10 to 35 mm. The distance between two adjacent nozzle openings 16 may be within a range of approximately 0.3 to 1 mm. The nozzle foil 12 consists of several foil segments 25 adjoining each other in longitudinal direction L. Two foil segments 25 adjacent each other in longitudinal direction L are mechanically connected with each other at a connecting point 26 (FIG. 2). In the preferred exemplary embodiments, a form-fitting connection is established between two adjacent foil segments 25. To do so, one foil segment 25 has connecting means 27 that interact with opposing connecting means 28 on the other foil segment in order to establish a connection. In addition to the form-fitting connection of two foil segments 25, it is possible to also connect said segments by substance-to-substance bonding at the connecting point 26, for example, by gluing them together. As a result of this, fluid tightness at the connecting point 26 is established or improved.

Referring to the illustrated preferred exemplary embodiments, the connecting means 27 have one and, as in the example, several connecting projections 29. Corresponding to the number of connecting projections 29, the opposing connecting means 28 have one or more connecting recesses 30. Considering a modification thereof, it would also be possible for the connecting means 27 to have connecting recesses 30 and for the opposing connecting means 28 to have connecting projections 29. The number of connecting projections 29 and of connecting recesses 30 may also vary. Considering the preferred exemplary embodiment, two connecting projections 29 and two connecting recesses 30 are provided on each connecting point 26 of two adjoining foil segments 25. The foil segment 25, including the associate connecting projections 29 and connecting recesses 30, respectively, are made in one piece of a uniform material, e.g., metal.

In the region of the connecting means 27 or the opposing connecting means 28, each foils segment 25 has a joining surface 33. With the connection established, the joining surfaces 33 of the connected foil segments 25 abut against each other at the connecting point 26.

Figure 7:
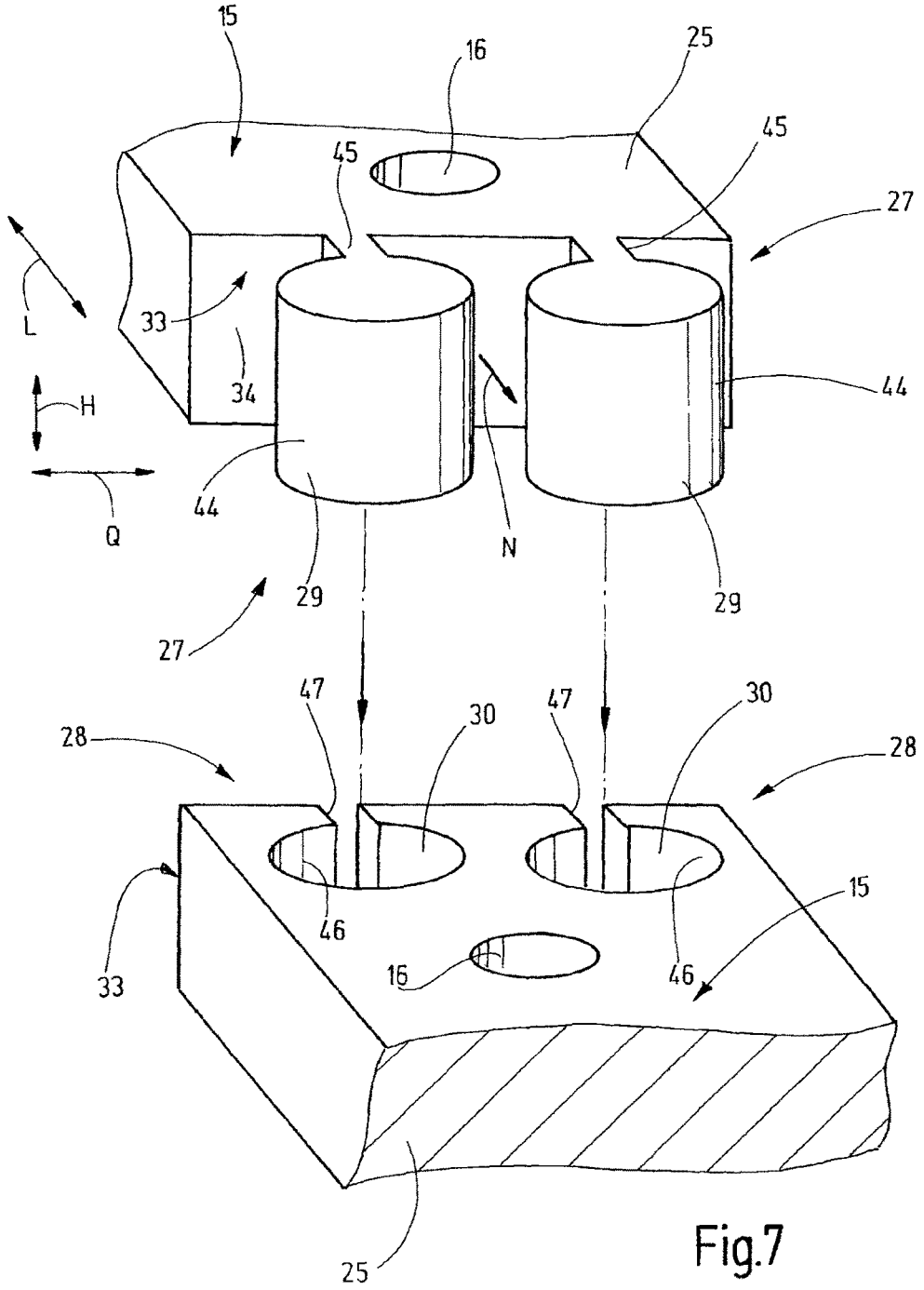
FIGS. 7 to 9 are schematic perspective representations of details of a foil segment of various embodiments of connecting means and opposing connecting means, respectively.

The joining surface 33 may extend in one plane, as is obvious, for example, from FIG. 7. There, the joining surface 33 extends in a plane that is defined by the transverse direction Q and a height direction H. The height direction H extends rectangularly with respect to the transverse direction A and the longitudinal direction L. In so doing, the surface normal N of the joining surface 33 points in longitudinal direction L.

Figure 4:
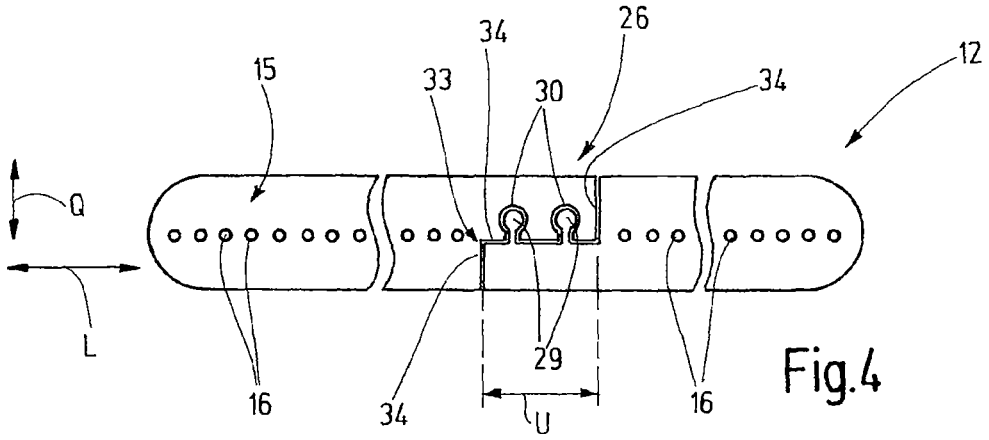
Figure 5:
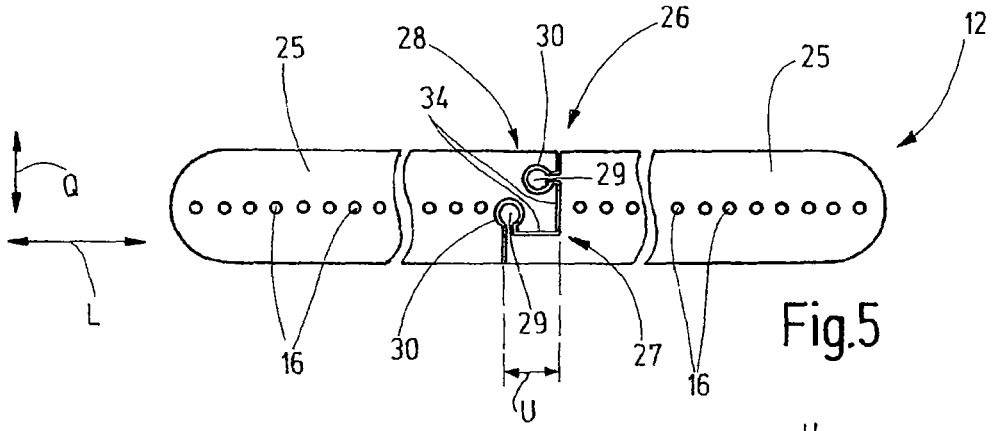
Figure 9:
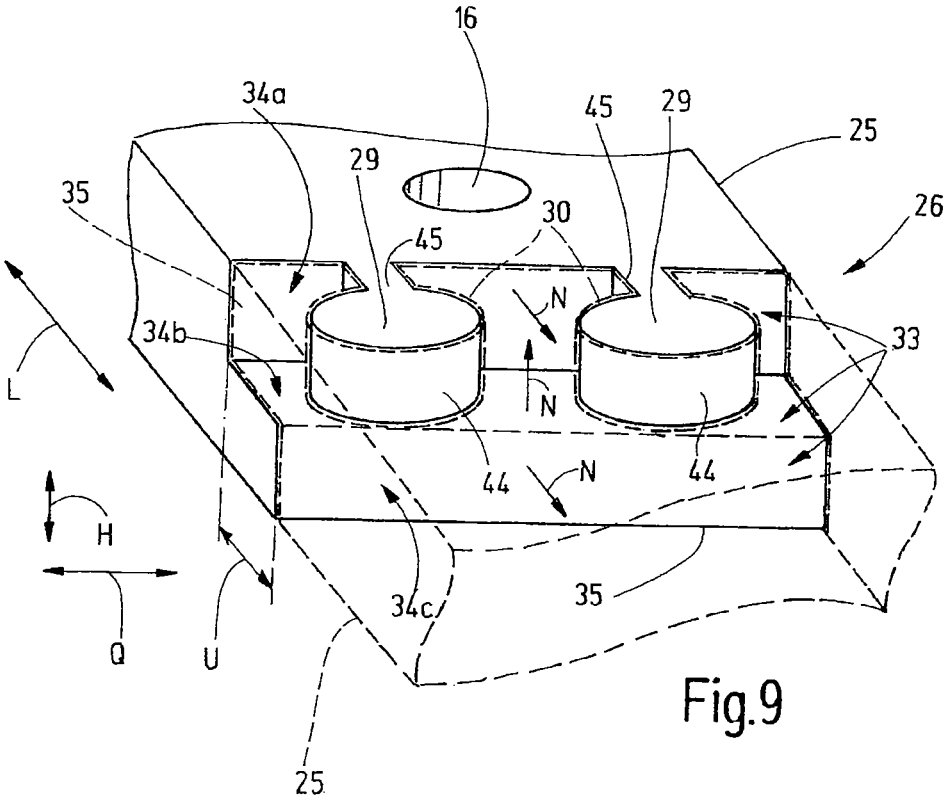

As an alternative thereto, it is also possible for the joining surface 33 of a foil segment 25 to have several surface segments 34. The surface normal N of at least two surface sections 34 of the joining surface 33 point in different directions. Consequently, a stepped joining surface 33 may be the result, for example, as is schematically shown in FIGS. 4, 5 and 9. Consequently, the two foil segments 25 that are connected with each other overlap in the connecting region 26. This means that they—as shown in FIGS. 4 and 5—extend next to each other in the connecting region 26 in longitudinal direction L along an overlap section U or—as shown in the exemplary embodiment in FIG. 9—in a superimposed manner. With the connection established, two adjacently associated surface areas 34 of the joining surfaces 33 of the two foil segments 25 abut against each other in the overlap section U. The surface normals N of these surface regions 34 abutting against each other along the overlap section U point in transverse direction Z or in height direction H in accordance with the exemplary embodiment.

Referring to the exemplary embodiment in accordance with FIG. 9, the foil segment 25 has a joining part 35 in the region of the connecting means 27, said joining part having the contour of a parallel epiped, for example. The connecting projections 29 are provided, in height direction H, above the joining part 35. The length of the two connecting projections 29 approximately corresponds to the length of the joining part 35. The length of the joining part 35 determines the length of the overlap section U. The connecting projections 29 project away from a first surface section 34*a* of the foil segment 25 and extend along a second surface section 34*b* that is formed by the upper side of the joining part 35. The face-side end surface of the joining part 35 represents the third surface section 34*c*. The three surface sections 34*a, b, c* form the joining surface 33 of the foil segment 25. The foil segment 25 to be connected therewith has two connecting recesses 30 that are provided in a joining part 35, said joining part 35—with the connection established in the overlap section U—being placed on the joining part 35 of the foil segment 25 having the connecting projections 29, as is illustrated by dashed lines in FIG. 9.

Figure 6:
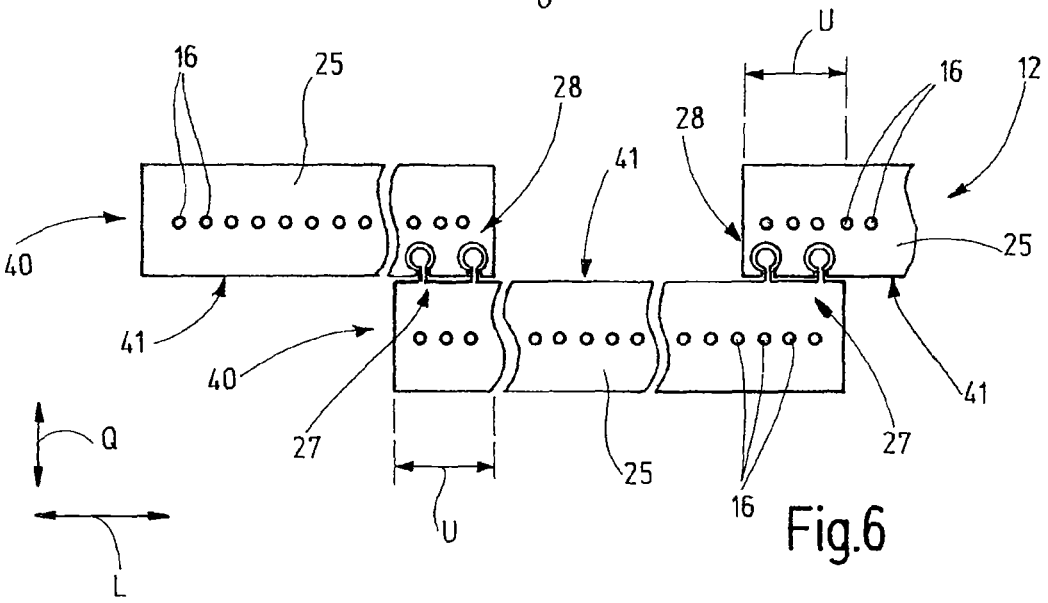

In the previously described exemplary embodiments of the nozzle bar 12, the foil segments 25 that are successive in longitudinal direction L are arranged so as to be in alignment with each other. In so doing, the longitudinal edges of the foil segments 25 form a longitudinal edge of the nozzle foil 12 that is essentially without steps. In so doing, the nozzle openings 16 are also arranged so as to be in alignment in a row extending in longitudinal direction L. Considering a modification thereof, the foil segments 25 in the exemplary embodiment in accordance with FIG. 6 are arranged so as to be offset relative to each other. In so doing, two rows 40 of nozzle openings 16 are formed, said rows extending parallel to each other. Different from the previously described embodiment options, the joining surface 33, in so doing, is represented by an end section of the lateral surface 41 of the foil segment 25, said end section extending in longitudinal direction L. As in the previously described exemplary embodiments, the connecting means 27 and the opposing connecting means 28, respectively, are provided on the joining surface 33.

Basically, the connecting projection 29 may have many different contours or shapes. Said projection projects away from a surface section 34 of the joining surface 33. Starting from this joining section 34, the connecting projection 29 widens at least in sections. As is obvious, for example, from FIG. 7, the connecting projection 29 has a widened end region 44. This widened end region 44, for example, has the shape of a circular cylinder or an oval cylinder and is connected with the surface section 43 of the joining surface 33 via a strip 45, said strip being narrower than the end region 44 when viewed in transverse direction Q, whereby the connecting projection 29 projects away from said joining surface 33. The height of the connecting projection 29 substantially corresponds to the thickness of the foil segment 25, viewed in height direction H.

The inside contour of the associate connecting recess 30 corresponds—apart from the required tolerance—to the outside contour of the connecting projection 29, so that a form-fitting connection can be achieved. Referring to the exemplary embodiment in accordance with FIG. 7, the connecting recess 30 thus has a cylindrical hole 46 that is open toward the joining surface 33 via a slit 47. The slit 47 is disposed to accommodate the strip 45. In this case, the direction of insertion in which the connecting projections 29 are inserted in the connecting recesses 30 corresponds to height direction H. Viewed in insertion direction, the connecting recesses 30 are open at least toward one side 15, 17.

Figure 3:
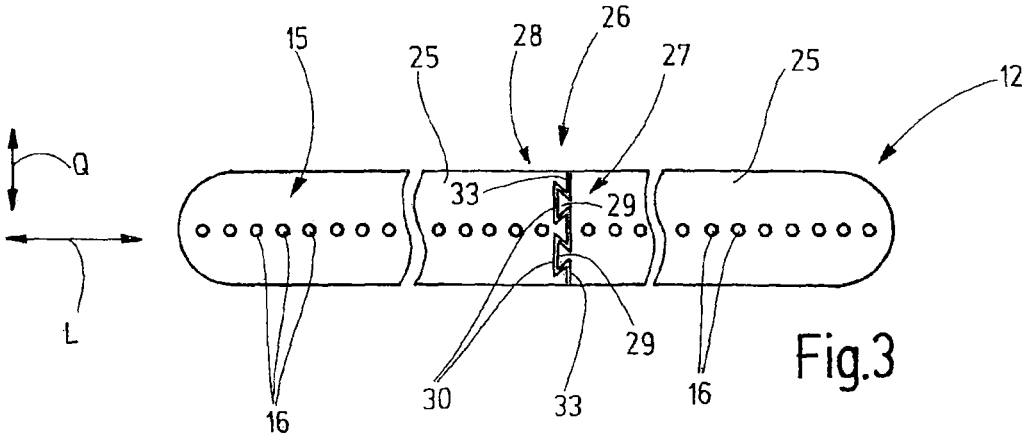

Considering a modification thereof, the connecting projections 29, as well as the corresponding connecting recesses 30, may also have the shape of a prism (FIG. 3). Viewed in plan view in accordance with FIG. 3, the connecting projection 29 has a trapeze-shaped contour. Starting from the joining surface 33, the connecting projection 29 widens continuously in transverse direction Q. Referring to the exemplary embodiment in accordance with FIG. 3, a so-called dove-tail joint is created between the foil segments 25.

Figure 8:
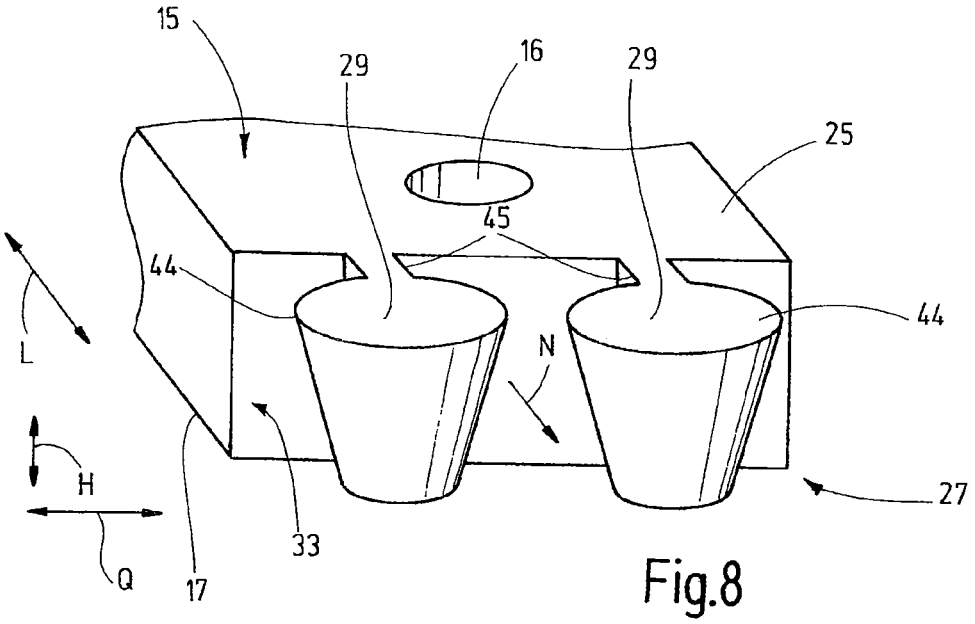

Considering another modification of the connecting means 27 in accordance with FIG. 8, the widened end section 44 of the connecting projection 29 tapers in height direction L, either toward the upper side 15 or, as shown by FIG. 8, toward the underside 17. For example, the widened end section 44 has the shape of a truncated cone. It is understood that the inside contour of the connecting recess 30 then also has the shape of a truncated cone. Due to the conical shape of the connecting projection 9, viewed in height direction when two foil segments 25 are connected, the upper side and underside of said foil segments can be extremely easily aligned in one plane. Likewise, considering other contours of the connecting projections 29 and the connecting recesses 30, respectively, said contours may have a form tapering in height direction H.

Considering the embodiment of the connecting means 27 and the opposing connecting means 28, respectively, there are additional variation options. Referring to the illustrated exemplary embodiments, the connecting projections 29 and the connecting recesses 30 of a foil segment 25 have the same size. Considering a modification thereof, it is also possible to choose different sizes for the connecting projections 29 and the connecting recesses 30 of a foil segment 25. Alternatively or additionally, the connecting projections 29 and the connecting recesses 30 of a foil segment 25 may also have different contours.

Referring to the preferred exemplary embodiments, the surface normals N of the joining surfaces 33 or the surface segments 34 extend in longitudinal direction L, in height direction H or in transverse direction Q. Considering a modification thereof, it would also be possible to provide surface sections 34 or joining surfaces 33, said surfaces having surface normals N being aligned inclined relative to longitudinal direction L and/or height direction H and/or transverse direction Q.

The invention relates to a nozzle foil 12 for a nozzle bar 10 of a textile processing machine. The nozzle foil 12 has a plurality of nozzle openings 16 that are arranged in one or more rows 40 in longitudinal direction L. The nozzle foil 12 consists of at least two foil segments 25. Respectively two adjacent foil segments 25 can be mechanically connected with each other and can, in particular, be connected in a form-fitting manner with each other. With the connection established, the upper sides 15 and the undersides 17 of the foil segments 25 are in a common plane. In order to accomplish a form-fitting connection, connecting means 27 are provided on a foil segment 25, said connecting means 27 interacting with the opposing connecting means 28 of the other foil segment 25. The connecting means 27 and the opposing connecting means 28 are integral components of the respective foil segment 25. In particular, the connecting means 27 and the opposing connecting means 28 are manufactured at the same time as the respective foil segment 25. Said connecting means consist of the same material as the respective foil segment 25.

It will be appreciated that the above description of the present invention is susceptible to various modifications, changes and modifications, and the same are intended to be comprehended within the meaning and range of equivalents of the appended claims.

LIST OF REFERENCE NUMERALS

10 Nozzle bar
11 Carrier element
11*a* Upper part of 11
11*b* Lower part of 11
12 Nozzle foil
13 Inlet channel
14 Pressure source
15 Upper side of 12
16 Nozzle openings
17 Underside of 12
18 Outlet channel
19 Water jet
20 Random fiber nonwoven
25 Foil segments

26 Connecting point
27 Connecting means
28 Opposing connecting means
29 Connecting projection
30 Connecting recess
33 Joining surface
34 Surface section of 33
34*a* First surface section
34*b* Second surface section
34*c* Third surface section
35 Joining part
40 Row
41 Lateral surface
44 End section of 29
45 Strip
46 Hole
47 Slit
H Height direction
L Length direction
Q Transverse direction
U Overlap section

What is claimed is:

1. Nozzle foil for a nozzle bar (10) of a textile processing machine, the nozzle foil comprising:

an elongate foil body defining a plurality of nozzle openings (16), the elongate foil body configured to be secured between an inlet channel (13) and an outlet channel (18) of a carrier element (11) of the nozzle bar (10) to allow pressurized fluid introduced into the inlet channel (13) to form fluid jets (19) extending out of the nozzle openings (16) and into the outlet channel (18) of the carrier element (11), wherein the elongate foil body comprises at least two foil segments (25) configured to connect with each other, wherein the elongate foil body has a thickness between 0.1to 1.5 millimeters.

2. Nozzle foil as in claim 1, wherein the foil segments (25) are configured to be connected with each other in a form-fitting manner.

3. Nozzle foil as in claim 1, wherein the foil segments (25) are connected with each other by a substance-to-substance bond.

4. Nozzle foil as in claim 1, further comprising connecting means (27) provided on at least one of the foil segments (25), the connecting means (27) interacting with opposing connecting means (28) on another foil segment (25) in order to establish connection of the two foil segments (25).

5. Nozzle foil as in claim 1, wherein individual ones of the at least two foil segments (25) define at least one connecting recess (30) configured to receive and engage a connecting projection (29) defined by another one of the at least two foil segments (25).

6. Nozzle foil as in claim 5, wherein the another one of the at least two foil segments (25) comprises a joining surface (33), and wherein the connecting projection (29) projects away from the joining surface (33) of the another one of the at least two foil segments (25).

7. Nozzle foil as in claim 6, wherein the connecting projection (29) has a widened end section (44).

8. Nozzle foil as in claim 7, wherein the widened end section (44) of the connecting projection (29) tapers in a direction (H) in which the connecting projection can be inserted in an associated connecting recess (30) of the at least one connecting recess (30) of the individual ones of the two or more foil segments (25) in order to establish a connection.

9. Nozzle foil as in claim 1, wherein individual ones of the at least two foil segments (25) comprise a joining surface (33), and wherein respective joining surfaces (33) of two foil segments of the at least two foil segments (25) that are connected with each other adjoin each other.

10. Nozzle foil as in claim 9, wherein one or more of the respective joining surfaces (33) extends in one plane.

11. Nozzle foil as in claim 9, wherein one or more of the respective joining surfaces (33) has surface sections (34) having surface normals (N) pointing in different directions (L, H, Q).

12. Nozzle foil as in claim 11, wherein two connected foil segments (25) overlap each other at a connecting point (26) between the two connected foil segments (25), and each of the two connected foil segments (25) comprises a joining part (35) configured to overlap with the joining part (35) of the other of the two connected foil segments (25) when connected;

wherein at least one surface section (34) of the one or more of the respective joining surfaces (33) is provided on the joining part (35).

13. Nozzle foil as in claim 1, wherein two connected foil segments (25) overlap each other at a connecting point (26) between the two connected foil segments (25).

14. Nozzle foil as in claim 13, wherein each of the two connected foil segments (25) comprises a joining part (35) which is configured to overlap with the joining part (35) of the other of the two connected foil segments (25) when connected.

15. Nozzle foil for a nozzle bar (10) of a textile processing machine, the nozzle foil comprising:

an elongate foil body defining at least four nozzle openings (16), the elongate foil body configured to be secured between an inlet channel (13) and an outlet channel (18) of a carrier element (11) of the nozzle bar (10) to allow pressurized fluid introduced into the inlet channel (13) to form fluid jets (19) extending out of the nozzle openings (16) and into the outlet channel (18) of the carrier element (11), wherein the elongate foil body comprises at least two foil segments (25) configured to connect with each other, wherein the at least four of the nozzle openings (16) are parallel with each other to effect the fluid jets (19) extending out from the at least four of the nozzle openings to be parallel to each other.

* * * * *